US005681190A

United States Patent [19]

Childs

[11] Patent Number: 5,681,190

[45] Date of Patent: Oct. 28, 1997

[54] TORSIONAL BLADE RECEPTACLE

[75] Inventor: Jonathan Childs, Rochester, Mich.

[73] Assignee: Cardell Corporation, Rochester Hills, Mich.

[21] Appl. No.: 448,304

[22] Filed: May 23, 1995

[51] Int. Cl.[6] ..... H01R 11/22

[52] U.S. Cl. ..... 439/856; 439/852; 439/861; 439/862; 439/842

[58] Field of Search ..... 439/842, 843, 439/851–857, 861, 862, 81, 82

[56] References Cited

U.S. PATENT DOCUMENTS

| | | | |
|---|---|---|---|
| 3,199,066 | 8/1965 | Eledge et al. | 439/857 |
| 4,241,970 | 12/1980 | Rider, Jr. et al. | 439/856 |
| 4,383,724 | 5/1983 | Ver Hoeven | 439/856 |

*Primary Examiner*—J. J. Swann

*Attorney, Agent, or Firm*—Jones, Tullar & Cooper, P.C.

[57] ABSTRACT

An electrical connector consists of a blade terminal and a formed metal receptacle having four independently acting resilient contact beams, housed within a rectangular hood or sleeve, which create four points of electrical contact between the blade and the body. The contact beams deflect and twist to absorb probing forces or blade removal torque, and additionally provide plural high pressure contacts which absorb mating blade angularity. The four points of contact are offset from each other, two on top of the blade and two underneath, providing a stable electrical connector between the blade and the receptacle to thereby eradicate concerns associated with fretting corrosion caused by unstable conditions often created by point or dimple contacts.

19 Claims, 8 Drawing Sheets

142
144
132
136
134
M
F
150
140
22
80
86
28
32
26
36
40
46
42
58
20
10
108
81
88
174
180
172
190
186
196
202
200
176
194
14
184
24
170
130
133

TORSIONAL BLADE RECEPTACLE

BACKGROUND OF THE INVENTION

The present invention relates, in general, to an improved electrical connector system, and more particularly to an improved spring-arm receptacle shaped to receive male blade-type terminals, and to provide improved contact therebetween.

Blade-type male terminals for electrical connectors are well known and are widely used in a variety of applications. As is known, a problem with such terminals is ensuring a reliable, low-resistance connection between the terminal and a corresponding receptacle, or socket. Uniform forces are important for this purpose, since such connectors may be subject to vibration or to a rocking motion of the terminal which may tend to loosen the connection and cause arcing or fretting corrosion. Such problems occur particularly in connector systems where there is only a single point of contact between the terminal and the receptacle, or two points of contact directly opposite each other, one on each side of the blade terminal, and lead to increased resistance and consequent heating of the connection, often resulting in open circuits or, in high power applications, in welding the connector components together, thereby preventing disassembly. An additional problem with existing blade terminal connectors is obtaining sufficient flexibility in the receptacle to allow the receptacle to absorb the stresses generated by the blade upon insertion and removal. A particular problem is to accommodate the insertion of a non-flexible blade which may be out of alignment with the receptacle; i.e., at an angle with the axis of the receptacle entry, or to accommodate the insertion of a blade which may be oversized or contain significant surface imperfections.

Many prior art connector receptacles, or sockets, utilize spring-like tines, or flexible spring arms, which typically provide a pair of opposed spring contacts which are spaced apart to receive a male terminal. However, if a terminal is inserted at an angle, for example, or if a terminal that is too large for the connector or is the wrong shape is inserted, permanent deformation of the spring contacts can occur due to overextension of the metal, with consequent loss of contact normal force. This results in reduced contact area which causes the resistance of the connector to increase, resulting in heating which further reduces the strength of the contact and causes rapid deterioration of the connection. The prior art has disclosed cantilever connector sections, some using domed or arch-type contacts, some with offset load points for improving package density, and some with offset contact pins for lessening insertion forces. However, these have not been completely satisfactory, and have not solved the problem of contact integrity for blade terminal cantilever beam contact spring arms, particularly where there is a large area, low pressure contact between the receptacle and the blade, in which a contaminate can separate the connection. An additional problem not addressed by the prior art is that of contact between the receptacle and blade at the edge of the receptacle body, at an area which is unplated, and which may thus provide undesirable resistance in the connection. A still further problem which is encountered in the prior art is that, in order to absorb overstress, a typical cantilever beam contact spring arm often is capable of sustaining only a low force contact, and is therefore good only for low current applications.

SUMMARY OF THE INVENTION

It is therefore an object of the present invention to provide an electrical connector including a first socket-type terminal, or receptacle, for receiving a second plug-type, or blade or tab terminal, wherein the receptacle includes at least one resilient contact arm which is shaped to provide contact integrity, and wherein the plug includes an elongated tip which is shaped to fit into the receptacle to engage the resilient arm.

It is a further object of the invention to provide an electrical receptacle for plug-type terminals having a blade, the receptacle having at least one spring-type contact arm which is shaped to provide an electrical contact with the blade for engaging the blade and for ensuring continuous contact.

Another object of the invention is to provide a receptacle for a male terminal wherein the receptacle has opposed, offset spring-type contact arms, which provide plural independent areas of contact with the terminal, thereby providing multiple current paths, and which produce a high pressure contact so as to prevent accumulation of contaminates.

Another object of the invention is to provide a receptacle for a male terminal having opposing spring-type arms each consisting of plural components able to deflect and twist to absorb potential overstress forces and torque forces produced by insertion and removal of the terminal into and out of the receptacle.

Another object of the invention is to provide an electrical receptacle for a blade terminal, the receptacle having opposed flexible arms with points of contact offset from each other to provide stable contact between the terminal and the receptacle by preventing rocking of the terminal about its centerline axis.

Another object of the invention is to provide an electrical receptacle having a surrounding hood for guiding a terminal into the receptacle and for preventing overflexing and resultant permanent deformation of receptacle spring contact arms due to overextending of the arms during insertion of the terminal.

Briefly, the present invention includes, in a preferred embodiment, an improved electrical connector having an elongated receptacle which consists of first and second opposed thin, flat, elongated cantilevered sheet metal contact spring arms for receiving a thin, elongated plug-type electrical terminal such as a flat blade terminal. In the preferred form of the invention, the elongated, opposed spring arms are located on opposite sides of, and extend parallel to, a longitudinal axis of the receptacle. The spring arms have a width which is perpendicular to a horizontal plane passing through the longitudinal axis, and form two side walls of the receptacle. Each arm has, in the preferred form, two horizontally extending, unitary, cantilevered, flexible spring-type tabs, spaced longitudinally along the spring arm, one at a forward, or free end of the arm, and the other at a rearward, or fixed, end. The tabs extend laterally inwardly, and each spring arm has one tab extending from a top edge and one from a bottom edge, toward the opposing spring arm.

Front and rear tabs extending from the top edges of the opposing arms cooperate to form a top wall of the receptacle. Similarly, rear and front tabs extend from the bottom edges of the opposing arms cooperate to form a bottom wall of the receptacle. Each of the four flexible tabs incorporates a pressed convex dome which extends inwardly toward the receptacle axis, and which serves as a contact point between the receptacle and the blade terminal.

The four flexible tabs may be considered as two pairs, a forward pair and a rearward pair. The tab pairs are oppositely disposed; that is, the forward pair has bottom and top tabs extending from the first and second spring arms, respectively, and the rearward pair has the opposite arrangement; i.e., has top and bottom tabs extending from their respective first and second spring arms. The first tab of each pair is above a horizontal plane passing through the receptacle axis, extends from one spring arm toward the opposing spring arm, and has its domed contact area on the far side of a vertical plane passing through the receptacle axis so that the contact area is in closer proximity to the opposing spring arm than to the arm from which it extends. Similarly, the second tab of each pair is below the horizontal plane, and has its domed contact on the far side of the vertical plane. This construction vertically offsets the contact areas from the centerline of the receptacle and produces a sufficient lever arm for each tab between its domed contact area and its spring arm to maintain a desired flexibility of the tab. The two opposed pairs of tabs produce four independent, vertically offset contact points which are formed on individually cantilevered, flexible tabs which can adapt to imperfections or misalignments on the blade terminal, and which can thereby provide reliable contact and multiple current paths between the receptacle and the terminal. Additionally, the vertically offset points of contact offer stability to the blade terminal by supporting it near its edges. This prevents rocking of the terminal within the receptacle, which rocking can interrupt the current flow within the electrical connector or can cause wear within the connector which could lead to fretting corrosion, either of which can render the electrical connection unsatisfactory.

The plug-type terminal component of the connector can take many forms, but preferably includes a thin, elongated metal tip secured in a sheet metal body. The tip is fabricated, for example, from a solid metal wire having a circular cross-section, and in one form the wire may be shaped, as by stamping or coining, to a desired width and thickness along a forward portion of its length to form a flat, blade-like terminal. The rearward portion, or near end, of the tip may remain round, and is secured in a forward portion of the sheet metal body by precision forming the stamped sheet metal body around the rearward portion of the wire. If desired, the wire may be secured in the body portion by solder. The rearward end of the terminal sheet metal body portion is shaped to receive and grip both the bare metal conductors and the surrounding insulation of a wire or cable, in well-known manner. The shaped wire and body portion constitute a plug-type terminal for an electrical connector, with the tip portion preferably in the form of a blade which is wider than it is thick, with flat upper and lower parallel surfaces for engaging corresponding contact points in a receptacle. The terminal may take many forms and may be fabricated in a variety of ways, but such terminals will hereinafter be referred to generally as blade terminals.

Also in a preferred form of the invention, the receptacle is fabricated from sheet metal to include two opposed, parallel sheet metal spring arms which are unitary with, and extend forwardly in cantilever from, a sheet metal body portion. The arms extend on opposite sides of, and are generally parallel to, a longitudinal axis of the receptacle, as noted above, are generally perpendicular to a horizontal plane passing through the receptacle axis, and in general form the side walls of the receptacle. The receptacle preferably is generally rectangular in cross section, with its rearward body portion having top, bottom, and first and second side walls surrounding the receptacle longitudinal axis. The first and second spring arms protrude from, and generally form an extension of, the first and second body portion side walls, respectively. The four flexible contact tabs discussed above extend horizontally from, and are formed as part of, the first and second spring arms and generally comprise extended top and bottom receptacle walls. The sheet metal spring arms are elongated, are generally planar and have widths greater than their thicknesses, are flexible and resilient, and extend in parallel spaced relationship on opposite sides of the longitudinal axis of the receptacle to define first and second vertical side walls of a central receiver cavity for the blade terminal discussed above. Similarly, the flexible unitary tabs are fabricated from the sheet metal of the sidewalls and are elongated, are generally planar, have widths greater than their thicknesses, are compliant and resilient, and extend in parallel spaced relationship on opposite sides of the longitudinal axis of the receptacle to define, in general, top and bottom horizontal walls of the central receiver cavity for the blade terminal.

In the preferred embodiment, the span between the side walls of the receptacle is greater than the span between the top and bottom walls of the receptacle, thereby establishing the horizontal axis of the cross-section of the rectangular receptacle as the major axis, corresponding to the width of the blade terminal. Similarly, the vertical axis of the cross-section of the rectangular receptacle is the minor axis, corresponding to the thickness of the blade terminal. The sheet metal body portion of the receptacle functions as the link between the forward spring arm portion of the receptacle, which provides contact with the blade terminal, and the rearward portion of the receptacle, which is shaped to receive and grip both the bare metal conductors and the surrounding insulation of a wire or cable, in well-known manner, to thereby form the receptacle, or socket, portion of an electrical connector.

Each contact tab forms an "L" shape with its corresponding spring arm when the receptacle is viewed from one end, longitudinally along the receptacle axis. In the preferred form, the first tab, which is part of the first pair of opposed tabs, extends horizontally from a first one of the vertical spring arm side walls and extends transversely below the receptacle axis. A second tab, which is part of the second pair of opposed tabs, is on the same spring arm and extends horizontally above the receptacle axis, both tabs and the first spring arm forming a "U" shape when viewed longitudinally along the receptacle axis. The first tab extends from the spring arm at its forward end, which is the end which first contacts the blade terminal, and includes a pressed convex dome, formed as by a crimping operation, which extends inwardly, or upwardly in this case, toward the receptacle axis and serves as a first point of contact with the blade terminal.

The first tab and the adjoining area of the first spring arm from which the tab extends may be described as being constructed of three beam components, each component representing not an independent physical entity, but rather a functional part of the unitary tab-spring arm structure. The first beam component, which generally comprises the tab, allows vertical deflection of the free end of the tab. This component acts as a cantilevered beam which is connected at its base to the spring arm. The free end of the beam deflects in the direction of the minor axis of the receptacle; i.e. vertically, in a manner to accommodate slight imperfections or misalignments of the blade terminal as it is inserted into the receptacle. The second beam component, which includes a portion of the tab and a portion of the adjoining first spring arm, allows lateral, or horizontal, deflection of the spring arm and the tab. This second component also acts as a cantilevered beam which deflects in the direction of the major axis of the receptacle, to accommodate misalignments of the blade terminal as it is inserted into the receptacle. The third beam component, which is contained generally within the first spring arm, allows twisting of the first tab about a longitudinal axis of the spring arm and also with respect to the second tab on the same spring arm, thereby accommodating torsion of the spring arm about the receptacle's longitudinal axis. Torsional forces on the spring arm may be caused by twisting or angularity of the blade terminal within the receptacle. In combination, these three beam components allow horizontal (lateral), vertical, and torsional deflection of the spring arm and tab in any combination required by the insertion of the blade terminal into the receptacle, and maintain a positive contact of the pressed dome with the blade terminal, thereby providing secure, reliable electrical contact between the terminal and receptacle.

The second flexible tab which extends from the same (first) spring arm is at the rearward end of the spring arm, and extends above the receptacle axis rather than below it. Its pressed convex dome extends inwardly, in this case downwardly, toward the receptacle axis and serves as a second point of contact with the blade terminal. The second tab and the adjoining area of the spring arm from which the tab extends incorporates three beam components, similarly to the first tab, allowing lateral vertical and torsional deflection of the second tab, substantially independently of the first tab. This provides a second secure, reliable point of electrical contact between the terminal and the receptacle.

The second spring arm extends longitudinally forward from, and is formed as a unitary part of, the body portion of the receptacle, similarly to the first spring arm, but on the opposite side of the receptacle longitudinal axis, thereby forming the opposing side wall to the first spring arm. Like the first spring arm, the second arm includes at least two flexible tabs which extend horizontally inwardly from the spring arm, each tab forming an "L" shape with the spring arm when viewed longitudinally along the receptacle axis, and forming, in the preferred embodiment, a "U" shape with the second spring arm when both tabs are viewed with the spring arm longitudinally along the receptacle axis. The first and second tabs which extend from the second spring arm are constructed similarly to the first and second tabs of the first spring arm, but are oppositely disposed; that is, the first tab on the forward end of the second spring arm extends above the receptacle axis and the second, or rearward, tab extends below the receptacle axis. In this way, the tabs from the first and second spring arms extend from similar longitudinal positions, but from opposed sides of the receptacle center line, thereby forming the opposing top and bottom walls of the receptacle. Four independently flexible points of contact, each offset from the others, are thereby maintained between the blade terminal and the receptacle, regardless of angularities, misalignments, or surface imperfections of the terminal blade.

As an additional measure to ensure proper insertion of the terminal into the receptacle, a separate rectangular, bent sheet metal hood, open at both ends as a rectangular tube, may be installed around the spring arms and attached to the rearward, formed sheet metal body portion of the receptacle. For example, it may be attached by shaping the metal hood, as by mechanically crimping it, so that it forms a secure, mechanical coupling by creating an interference between the hood and the receptacle body. The rectangular hood is sized to function as a physical stop to limit the outward deflection of the spring arms, so as to preclude overextension of the arms, thus reducing the potential for metal fatigue or sudden brittle fracture of the arms. Inwardly extending stops, in the form of domes or indents, may also be formed along the length of the hood to additionally prevent excessive outward motion of the spring arms during insertion of an imperfect terminal blade. The leading edge of the hood is bent inwardly to guide the blade terminal into the interior of the receptacle.

BRIEF DESCRIPTION OF THE DRAWINGS

The foregoing and additional objects, features, and advantages of the present invention will become apparent to those of skill in the art from a consideration of the following detailed description of a preferred embodiment thereof, taken in conjunction with the accompanying drawings, in which.

DESCRIPTION

Figure 1:
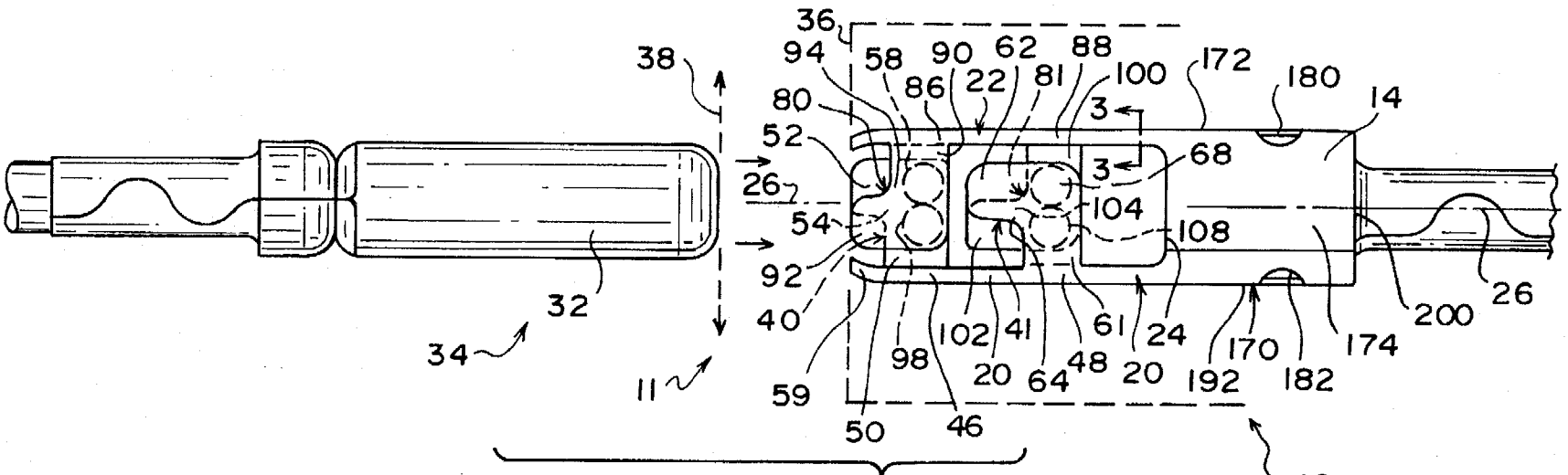
FIG. 1 is a top plan view of an electrical connector having a blade-type plug terminal and a spring arm-type receptacle or socket in accordance with the preferred embodiment of the present invention.
Figure 3:
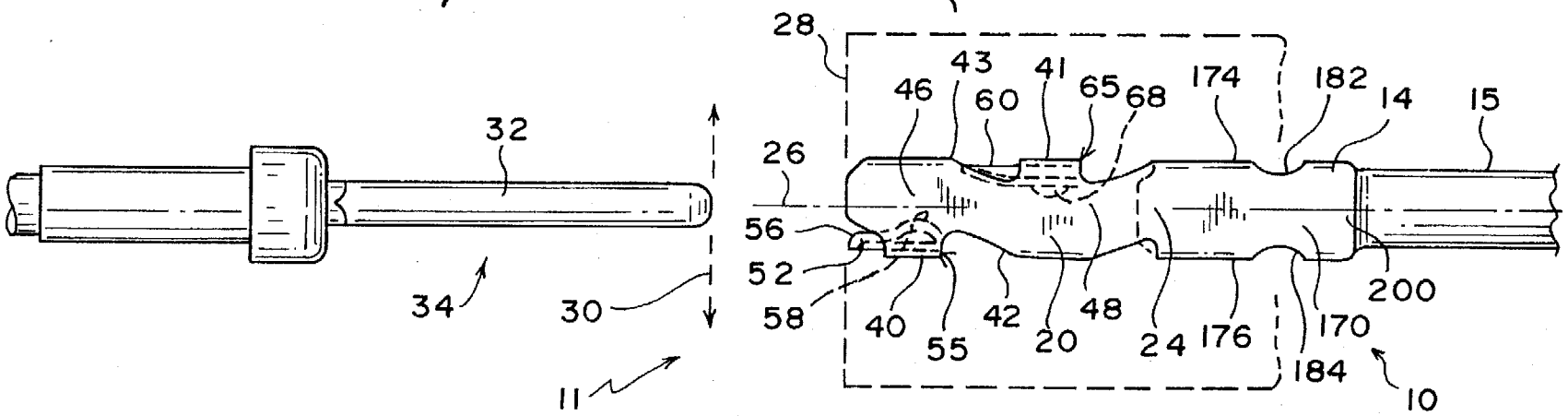
FIG. 3 is a side elevation view of the receptacle and plug terminal of FIG. 1.
Figure 2:
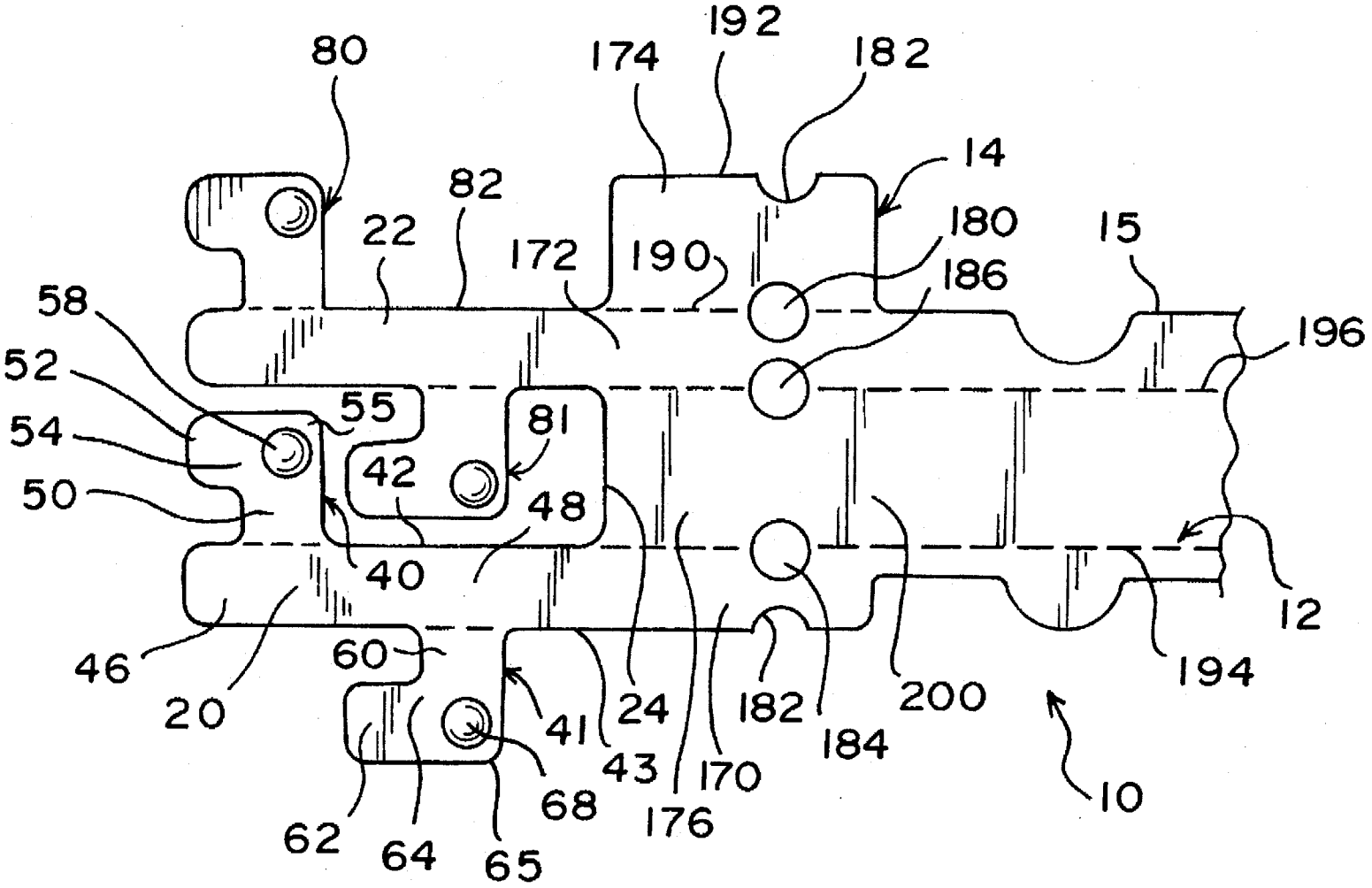
FIG. 2 illustrates the receptacle of FIG. 1 in its stamped metal configuration, prior to any forming processes.

Turning now to a more detailed description of the present invention, there is illustrated in FIGS. 1–3 a receptacle, or socket 10, for an electrical connector 11 in accordance with the present invention. The receptacle 10 is stamped as a single sheet metal piece, shown in FIG. 2, and then precision formed in successive production steps to fold it along the dotted lines 12 in well-known manner. The receptacle generally comprises a formed rearward body portion 14, having a rearwardly extending wire crimping section 15, best illustrated in FIG. 4, and a pair of forwardly extending spring arms 20 and 22, which protrude from the body portion 14 at its forward end 24. The spring arms 20, 22 are generally planar and are located on opposite sides of the receptacle centerline axis 26 (FIG. 1) and form walls which are generally parallel to a receptacle vertical plane 28 (FIG. 3), which passes through axis 26. Plane 28 is also parallel to a thickness axis 30 of a blade type plug 32 of a terminal 34 when the plug is seated in the receptacle 10. The spring arms are also perpendicular to a horizontal receptacle plane 36 (FIG. 1) passing through axis 26.

The first spring arm 20 includes two flexible tabs 40 and 41 which extend laterally inwardly across the receptacle centerline 26, and which originate on lower and upper edges, 42 and 43, respectively, of arm 20, on opposite sides of horizontal plane 36. The first tab 40 originates at a forward portion 46 of spring arm 20, and the second tab 41 originates at a rearward portion 48 of spring arm 20. The tabs curve inwardly from arm 20 to respective free ends, and are generally parallel to, but tilt slightly inwardly toward, the plane 36 (see FIG. 5) so that the terminal, or free, end of each tab is slightly closer to plane 36 than is its point of origin at the edge of arm 20, as will be described below. The first tab 40 has a laterally reaching segment 50 (FIG. 1) extending from the spring arm and a forwardly-reaching segment 52 extending from segment 50 to form a generally "L" shaped tab, as illustrated in the top plan view of FIG. 1, segment 50 forming a corner 54 where it meets segment 52. The forwardmost edge 56 of tab 40 is beveled forwardly and outwardly to facilitate insertion of a plug-type terminal into the receptacle.

Figure 4:
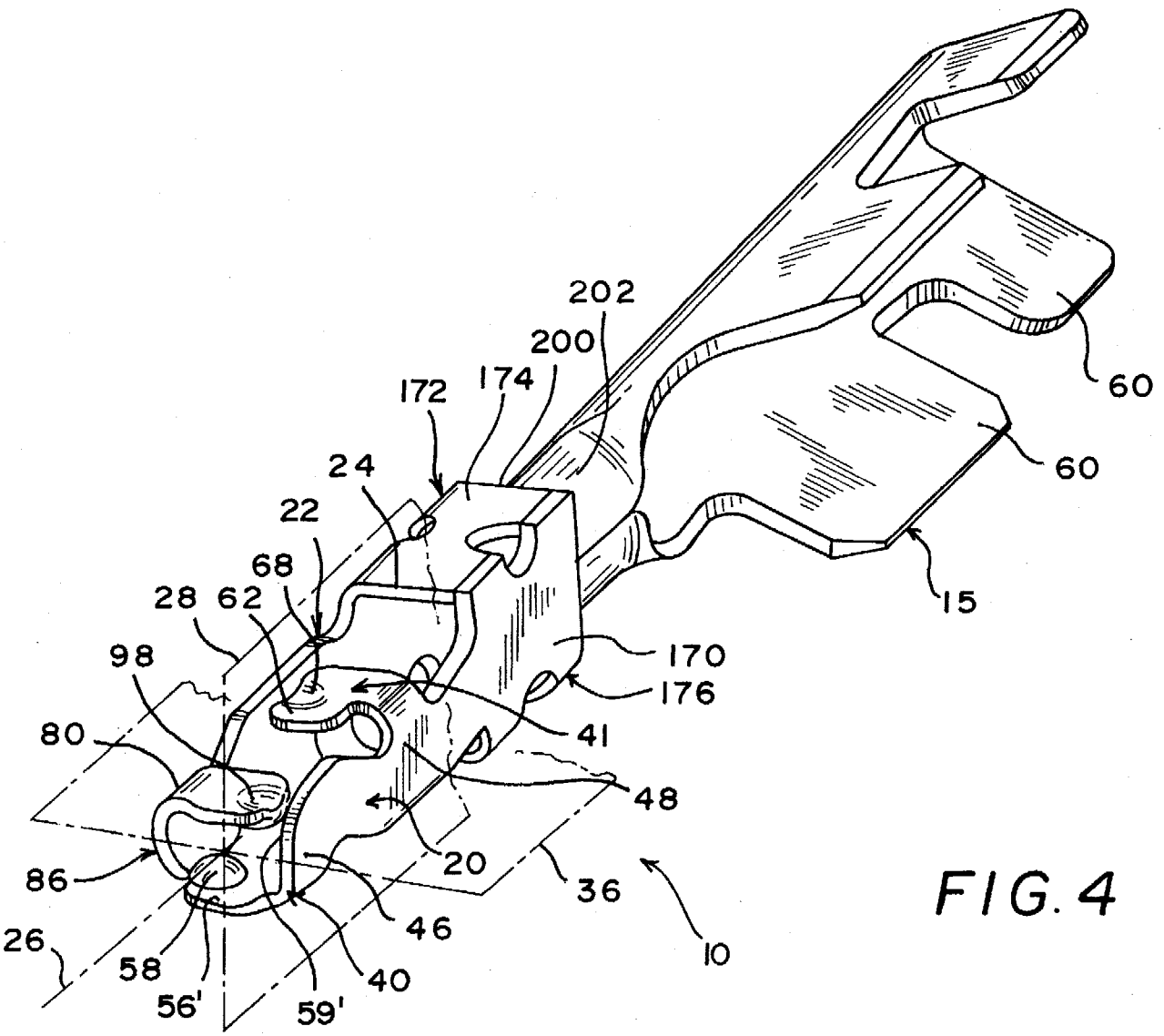
FIG. 4 is a perspective view of the receptacle of FIG. 1.

Located in segment 50 of the first tab 40, near the corner 54, is a convex dome 58 which is pressed inwardly toward the receptacle horizontal plane 36, as illustrated in FIG. 4, and which is one of the contact areas between the receptacle 10 and the terminal blade 32 when the blade is in place in the receptacle. The dome 58 may be formed as by a crimping or pressing procedure during or subsequent to the process of stamping out the sheet metal receptacle 10 as represented in FIG. 2, and preferably prior to the forming operations which result in the receptacle represented in FIGS. 1 and 3. As best illustrated in FIG. 5, the slightly upward tilt of tab 40 toward the plane 36 causes the dome 58 to be in closer proximity to the plane 36 than is the origin of the tab 46 where it intersects spring arm 20 at edge 42.

Figure 5:
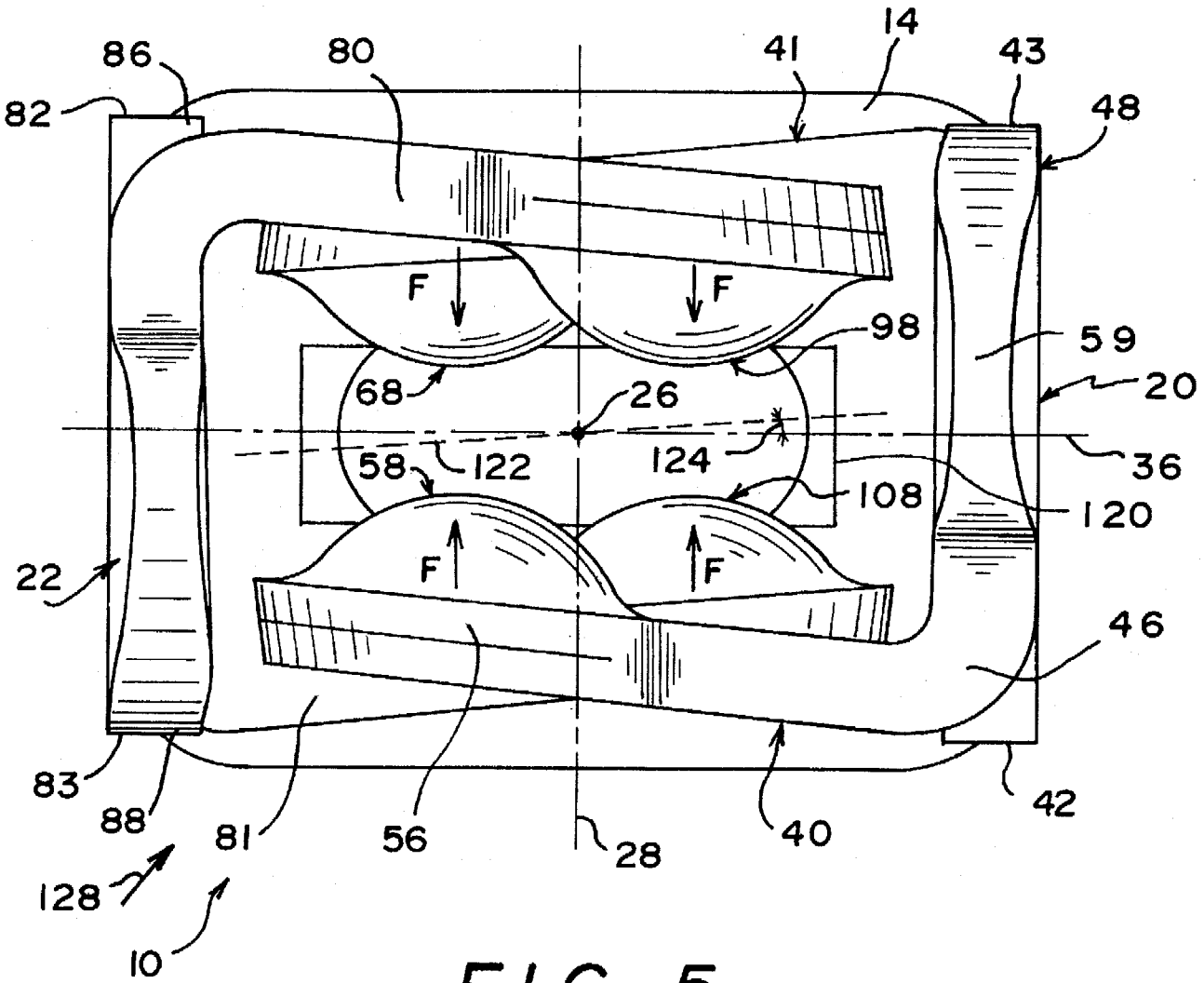
FIG. 5 is an enlarged end view of the receptacle of FIG. 1.

In the embodiment of FIGS. 1, 3, and 5 the forwardmost end of spring arm 20 extends forwardly beyond the location of the lateral portion 50 of tab 40 to form a nose portion 59 which is coplanar with the forward edge of tab portion 52 in a plane perpendicular to axis 26. As illustrated in FIG. 1, the nose portion 59 may be curved slightly inwardly; otherwise the spring arm is substantially planar along its entire length.

FIG. 4 illustrates a slightly different embodiment, wherein the forwardmost end of the spring arm 20 does not include a nose portion, but the top edge 43 is curved downwardly, as at 59', to intersect with the forward edge of tab portion 50 so that the tab portion 50 forms the forward edge of the receptacle. The tab portion 52 is omitted in this embodiment, with the forward edge of portion 50 being beveled as at 56' to facilitate insertion of a plug-type terminal. It is noted that the rearwardmost portion 15 of the receptacle, as illustrated in FIG. 4, in includes conventional crimping fingers 60 for gripping the insulation on the wire or cable to which the receptacle is fastened. In the embodiments of both FIGS. 1–3 and FIG. 4, the second tab 41, which extends laterally inwardly from the upper edge of first spring arm 20, also has a laterally-reaching segment 61 which forms, together with a forwardly-reaching segment 62, a generally "L" shape in the top plan view, the two segments meeting to form a corner 64. Located in segment 61 of the second tab, near the corner 64, is a convex dome 68 which is pressed inwardly (downwardly as viewed in FIG. 4) toward the receptacle horizontal plane 36, and which forms another contact area between the receptacle 10 and the terminal blade 30. As best illustrated in FIG. 5, the tab 41 is tilted slightly downwardly toward the plane 36, so that the dome 68 and the free end of the tab are in closer proximity to the plane 36 than is the origin of the tab at the top edge 43 of spring arm 20. As can be seen from FIG. 5, the first and second contact domes 58 and 68 are located on the same side of vertical plane 28, but on the opposite side of plane 28 from the spring arm 20 and the points of origin 46 and 48 of their respective tabs 40 and 41. This extension of the tabs across the width of the receptacle provides elongated lever arms for the domes to allow vertical (outward) motion of the tabs with respect to plane 36 upon insertion of a blade terminal having a thickness greater than the distance between domes 58 and 68.

Returning to FIGS. 1–3, the second spring arm 22 is similar to spring 20 and includes two flexible tabs 80 and 81 which extend laterally across the receptacle centerline 26, and which originate at upper and lower edges 82 and 83, respectively of arm 20, on opposite sides of plane 36. The first tab 80 originates at a forward portion 86 of spring arm 22, and the second tab 81 originates at a rearward portion 88 of spring arm 22. The tabs are similar to tabs 40 and 41, and thus are generally parallel to horizontal plane 36, but tilt slightly inwardly toward the plane 36 so that the free end of each tab is slightly closer to the plane 36 at the point of termination than at the point of origin, as discussed above with respect to tabs 40 and 41. Accordingly, the first tab 80 extends from the upper edge 82 of spring arm 22 and has a laterally-reaching segment 90 which forms, together with a forwardly-reaching segment 92, generally an "L" shape in the top plan view, and forms a corner 94 where segment 90 meets segment 92. Located in segment 90 of the first tab 80, near the corner 94, is a pressed inwardly convex dome 98 which reaches inwardly toward the receptacle horizontal plane 44, as shown in FIG. 5, and which is a third contact area between the receptacle 10 and the terminal blade 30. Referencing FIG. 5, the tab 80 is tilted slightly downwardly toward the plane 36, so that the dome 98 is in closer proximity to the plane 36 than is the origin 86 of the tab.

The second tab 81, which extends from lower edge 83 of the second spring arm 22, has a lateral segment 100 which forms, together with a forwardly-reaching segment 102, generally an "L" shape in the top plan view. A corner 104 is formed where segment 100 meets segment 102. Located in segment 100 of the second tab 82, near the corner 104, is a pressed inwardly convex dome 108 which reaches inwardly toward the receptacle horizontal plane 44, and is the fourth and final contact area between the receptacle 10 and the terminal blade 30 when the blade is properly seated in the receptacle. Referencing FIG. 5, the tab 81 is tilted slightly upwardly toward the plane 36, such that the dome 108 and the free end of the tab are in closer proximity to the plane 36 than is the origin of the tab 88 on lower edge 83.

The contact domes 98 and 108 are located on the same side of vertical plane 28; i.e., are on the side of plane 28 opposite from the points of origin 86 and 88 of their respective tabs 80 and 81. Additionally, FIG. 5 illustrates that the contact domes 98 and 108 are on the same side of vertical plane 28 as the points of origin 46 and 48 of tabs 40 and 42 on spring arm 20. Similarly, the contact domes 58 and 68 are on the far side of plane 28 from their points of origin 46 and 48 and are on the opposite side of plane 28 from contact domes 98 and 108.

FIG. 5 further illustrates that the contact domes 58 and 68, not only lie on the opposite side of vertical plane 28 from contact domes 98 and 108, respectively, but are also on opposite sides of the horizontal plane 36. It is further illustrated that contact domes 98 and 108, which have their origin on spring arm 22, are on opposite sides of the plane 36 from one another. As illustrated by the end view along the longitudinal axis of the receptacle of FIG. 5, the lower contact dome 58 on tab 40 is positioned forward of the contact dome 108, which is on tab 82, and additionally that the upper contact dome 98 on tab 80 is forward of the upper contact dome 68 on tab 42. The four tabs 40, 80 and 41, 81 thus comprise two pairs with corresponding pairs of forward contact domes 58, 98 and rearward domes 68, 108 symmetrically but oppositely offset from the receptacle centerline axis 26 and from vertical plane 28. When viewed longitudinally from the end as in FIG. 5 the spring arm 20 and the tabs 40 and 41 generally form a "U" shape which opens to the left, with the corresponding domes such as 58 and 68 in slightly closer proximity to the horizontal plane 36 than the points of origin 46 and 48 of their respective tabs. Similarly tabs 80 and 81 and arm 22 from a "U" shape that opens to the right. FIG. 5 demonstrates how the terminal blade 32 of FIG. 1 can be accommodated by receptacle 10, with rectangle 12 diagrammatically representing the blade cross section. Angularity of the blade 120, caused by misalignment of the terminal 34 with respect to the receptacle 10 during insertion, results in a mismatch or offset of the blade horizontal axis 122 with respect to the receptacle horizontal plane 36, as by an angle 124. This mismatch can be accommodated by the flexibility of the tabs 40, 41, 80, and 81, and can additionally be restricted by limiting the outward deflection of the tabs to some predetermined amount, as will be shown below in FIGS. 8 and 9.

Figures 6, 6A, 6B, 6C:
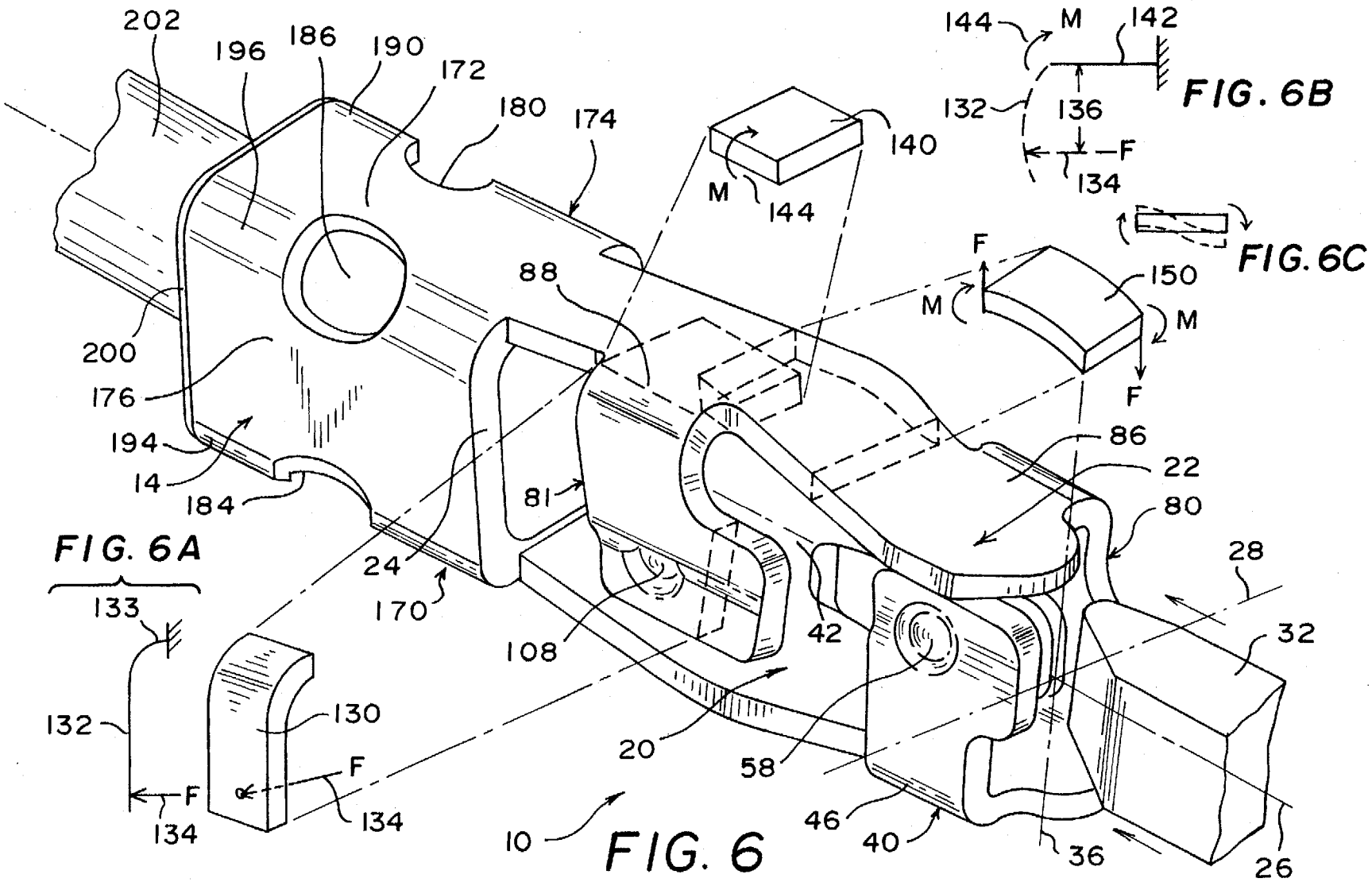
FIGS. 6, 6*a*, 6*b*, and 6*c* provide is a perspective view of the receptacle of FIG. 1, showing in phantom and in exploded views the functional beam components which provide the flexibility of the spring arms.

FIG. 6 illustrates for tab 81 the three functional beam components, discussed above, which represent the mechanical motions of the tab. FIG. 6 is a bottom perspective view of the receptacle of FIGS. 1–3 and 5, taken in the direction of arrow 128 (FIG. 5). A first beam component 130, which generally comprises the tab 81, allows vertical deflection of the tab (parallel to plane 28). Component 130 acts as a cantilevered beam 132, (FIG. 6A) which is fixed at one end 133 and has a free end which deflects due to a force 134, such as that caused by an ill-fitting terminal blade 32, in a direction parallel to plane 28. A second beam component 140, which generally comprises a portion of the tab 81 and a portion of the adjoining spring arm 21 in the area 88, allows horizontal deflection of the tab in a direction parallel to plane 36. Component 140 also acts as a cantilevered beam 142 (FIG. 6B) which deflects due to a moment 144 such as that caused by thrusting the component 130 outwardly as by the force 134 applied at a moment arm offset 136. A third beam component 150, which is contained generally within the spring arm 21, allows twisting of the tab 81 with respect to the spring arm 21 and also with respect to the second tab 80 on the spring arm, thereby accommodating torsion of the spring arm 21 about the receptacle's longitudinal axis 26. Such torsional forces may be caused, for example by twisting or angularity of the terminal blade 32 within the receptacle 10.

The three beam components 130, 140, and 150 of tab 81 combine to allow vertical, lateral and torsional deflection of the spring arm 21 and tab 81 in directions parallel to planes 28 and 36, in response to the placement of the blade 32 within the receptacle 10, in order to ensure rigid, positive contact of the pressed dome 108 with the blade 32. Similarly, the tabs 40, 41, and 80 incorporate three functional beam components allowing deflection and twisting of the tabs to accommodate misalignments and imperfections of the terminal blade 32.

Figure 7:
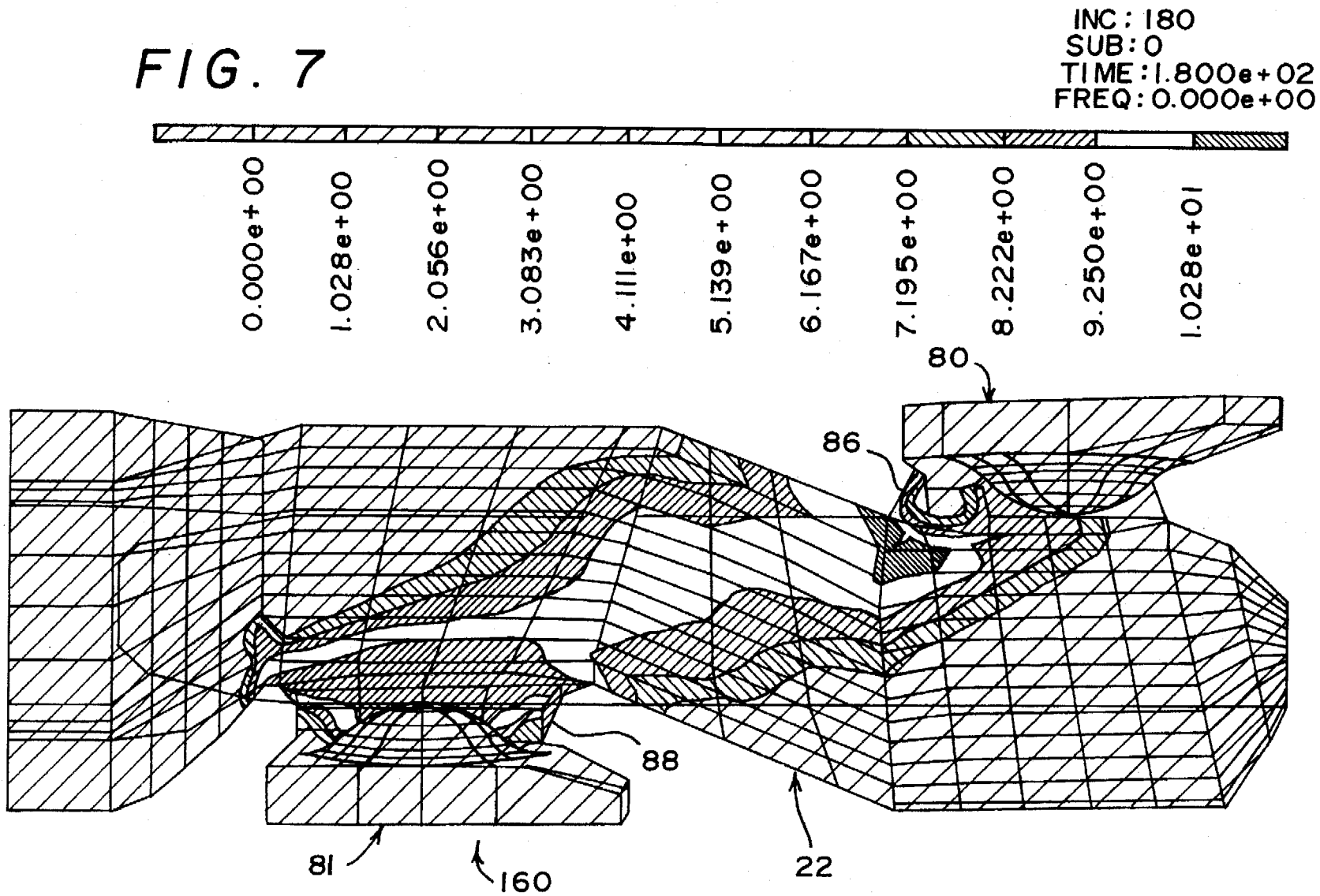
FIG. 7 is a diagrammatic illustration of the stress distribution within a spring arm of the receptacle of FIG. 1, with the blade terminal inserted.

Turning to FIG. 7, there is illustrated a stress distribution diagram 160 for the spring arm 22. This figure illustrates for tab 81 the deflection stresses which occur in the beam components 130 and 140 near the origin 88 and the torsional stresses which occur in beam component 150 along the spring arm 22. A similar stress distribution is shown for tab 80, and it will be understood that similar stress distributions occur for tabs 40 and 41 on spring arm 20. These stress patterns are produced when the terminal blade 32 is fully inserted into the receptacle.

Referring again to FIGS. 1–3 and 5, as well as to the perspective view of FIG. 6. The body portion 14 of the receptacle is generally rectangular in cross section, having side two walls 170 and 172 in parallel spaced relationship on opposite sides of the vertical plane 28 of the receptacle, and top and bottom walls 174 and 176 in parallel spaced relationship on opposite sides of the horizontal plane 36 of the receptacle. As best illustrated in FIGS. 2 and 6, indents, or openings, 180, 182, 184 and 186 are provided at the corners of body portion 14, opening 180 being centered longitudinally along a fold line 190 between side wall 172 and top wall 174, opening 182 (hidden from view in FIG. 6) being centered along a corner 192 between top wall 174 and side wall 170, opening 184 being centered along a fold line 194 between side wall 170 and bottom wall 176, and opening 186 being centered along a fold line 196 between bottom wall 176 and side wall 172. The openings 180, 182, 184 and 186 preferably are formed in the stamping operation which produces the sheet metal of FIG. 2. If indentations are provided instead of openings, these may be produced during forming of the rectangular body portion 14.

The posterior or rearward end 200 of the receptacle body 14 is reduced in size to produce the rearward gripping portion 15 for the receptacle 10 illustrated in FIG. 4. This portion is conventional, and is shaped to receive and grip both the bare metal conductors and the surrounding insulation of a wire or cable to which the receptacle is to be connected, in well-known manner, which will not be further described herein.

Figure 8:
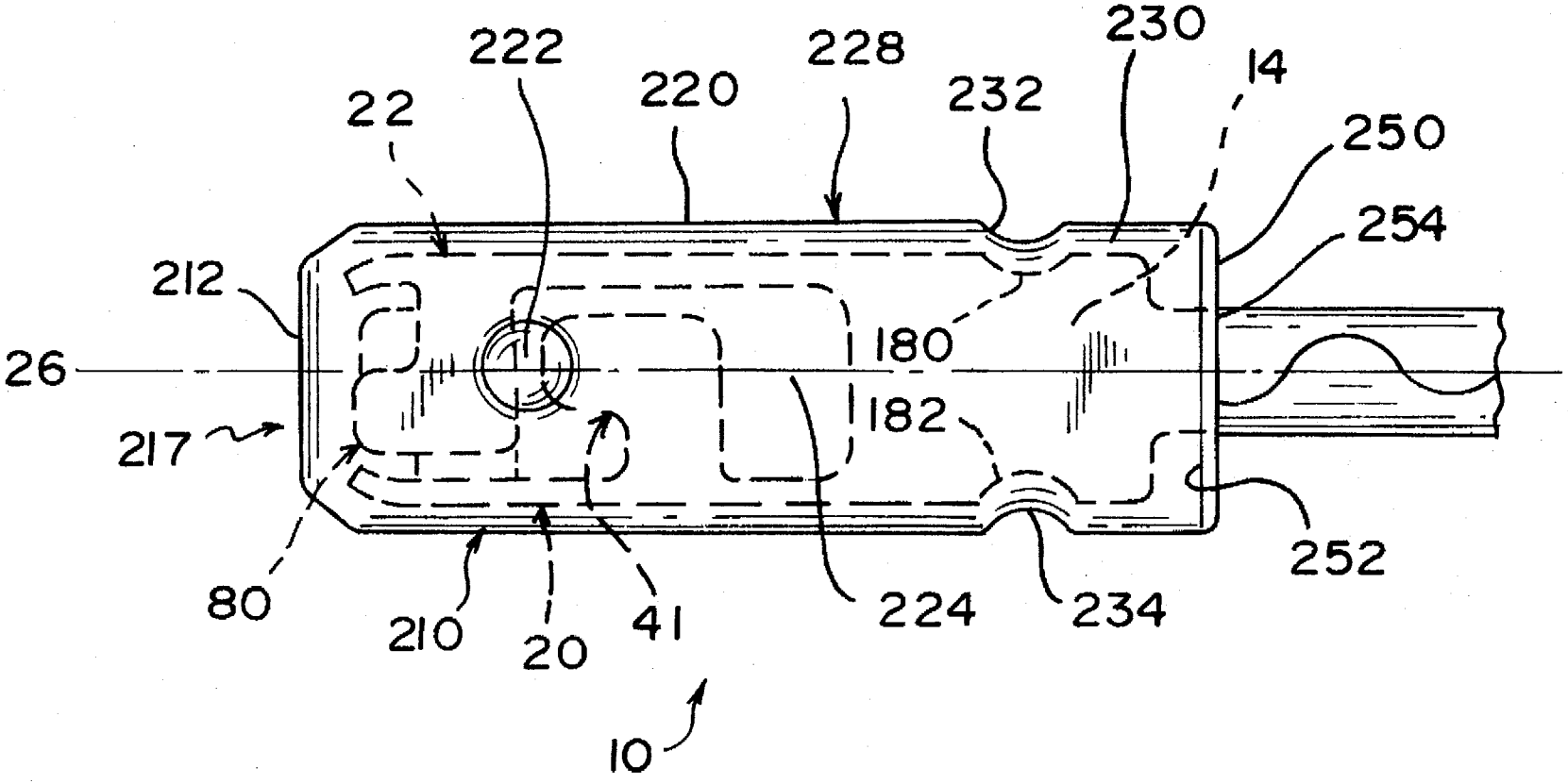
FIG. 8 is a top plan view of the receptacle of FIG. 1 further incorporating a protective hood.
Figure 9:
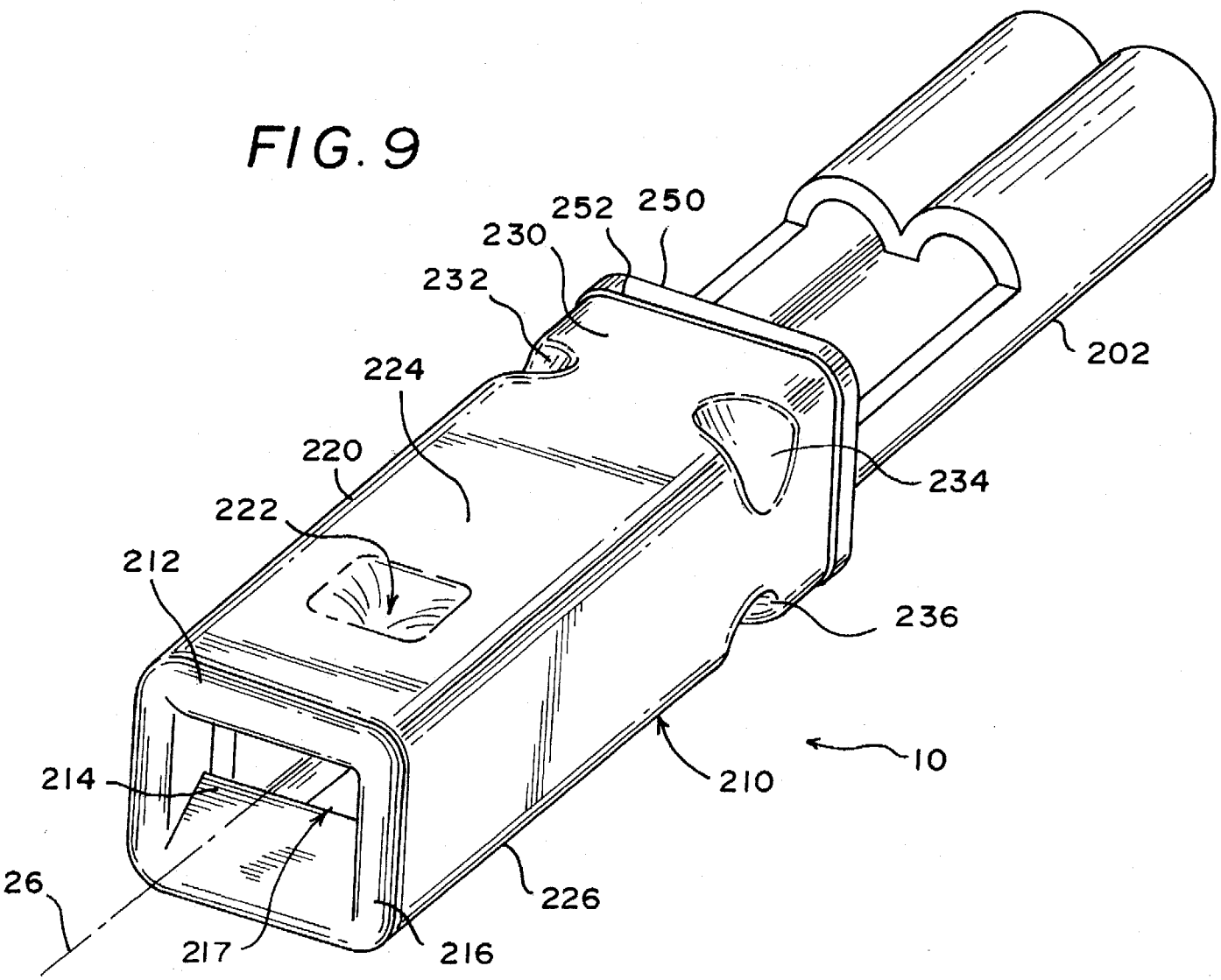
FIG. 9 is a perspective view of the receptacle and hood of FIG. 8.

FIGS. 8 and 9 illustrate a protective hood or sleeve 210 for the receptacles of FIGS. 1 and 4. The hood 210 is stamped as a single sheet metal piece which is then formed, in successive production steps, into a protective sleeve which is generally rectangular in cross section, and which fits easily around and is secured to the receptacle body 14 and extends forwardly over the spring arms 20 and 22 and tabs 40, 41 and 80, 81. A forward portion 212 of the hood includes an inwardly folded end 214 of the sheet metal piece, the end 214 being folded on itself to form a smooth, rounded front end surface 216 which will not abrade or catch the terminal blade 32 as it is inserted into the receptacle 10, and which further acts as a guide to route the terminal blade into a receptacle front aperture 218 and thence into the interior of the receptacle.

The center section 220 of the hood may include dimples or indents 222 on top and bottom walls 224 and 226, respectively, which may be formed as by pressing or crimping the sheet metal of the hood. Hood walls 224 and 226 are in parallel spaced relationship to the top and bottom walls 174 and 176 of the receptacle body 14 and to the top tabs 80 and 41 and the bottom tabs 40 and 81, respectively, for the purpose of restricting the outward deflection of the tabs 40, 41, 80, and 81, thereby preventing overextension of the tab metal and limiting the fatigue and fracture of the tabs. Optionally, similar dimples may be formed on the side walls 228 and 230 of the hood, which are in parallel spaced relationship to the side walls 172 and 174, respectively, of the receptacle body 14 and to spring arms 22 and 20, respectively, to restrict the outward deflection of the spring arms 20 and 22. The rearward section 230 of the hood also contains dimples or indents 232–235, which are pressed inwardly, or crimped, after the hood 210 is installed around the receptacle body 14, so that these dimples protrude inwardly toward the receptacle centerline 26 and engage corresponding openings 180, 182, 184 and 186 of the receptacle body 14. This creates an interference between the receptacle body portion 14 and the hood 210, thereby securing the hood on the receptacle body. The rearwardmost end 250 of the hood is folded inwardly on itself, so as to form a smooth rounded edge 252 which surrounds the rearward portion 200 of the receptacle.

Although the present invention has been described in terms of preferred embodiments, it will be apparent that variations and modifications may be made without departing from the true spirit and scope thereof, as set forth in the following claims.

What is claimed:

1. An electrical connector comprising:

a plug-type terminal having an elongated contact tip; and a receptacle including a longitudinal body portion having a longitudinal body axis, a rearward portion extending rearwardly from said body portion and shaped to engage a wire and wire insulation to form a part of an electrical harness, and a forward portion consisting of first and second elongated arms extending forwardly from said body portion, said arms being opposed and symmetrical about said receptacle longitudinal body axis to form first and second side walls of said receptacle forward portions, said arms including areas for contacting said terminal, wherein said first elongated arm of said forward portion is resilient and able to deflect as said terminal is inserted into said receptacle along said longitudinal axis, and further is able to maintain a constant pressure between a contact area and said terminal after insertion to assure continuous electrical conductivity and security of said terminal, wherein said second elongated arm of said forward portion is opposed to said first elongated arm, and is additionally resilient and able to deflect as said terminal is inserted into said receptacle along said longitudinal axis, and further is able to maintain a constant pressure between a contact area and said terminal after insertion, assuring continuous electrical conductivity and security of said terminal, wherein said first and second arms include plural unitary opposed flexible tabs extending laterally from said first and second arms to respective free ends, said tabs inclining inwardly toward said receptacle longitudinal body axis at said free ends, and said tabs further forming top and bottom walls of said receptacle forward portion, wherein said tabs are located in pairs, the tabs of a pair being oppositely disposed to extend laterally and inwardly from corresponding said first and second arms, said tabs comprising contact areas between said receptacle and said elongated contact tip for ensuring multiple current paths, wherein each said tab is comprised of plural beam components to allow said tabs to deflect and twist, absorbing overstress forces and torque forces produced by insertion and removal of said elongated contact tip into and out of said receptacle.

2. The receptacle of claim 1, wherein said body portion includes indents for receiving a hood.

3. The receptacle of claim 2, further including a hood secured to said body portion by crimping said hood at locations coinciding with said indents in said body portion.

4. The receptacle of claim 3, wherein said hood extends forwardly along said receptacle longitudinal axis, enclosing said two opposed elongated arms.

5. The receptacle of claim 4, wherein said hood further incorporates indents for limiting motion of said elongated arms.

6. The receptacle of claim 1, wherein each tab is generally L shaped, each said tab including an indent located at the corner of said "L" shape, extending inwardly toward said receptacle longitudinal body axis, and constituting said contact areas.

7. The receptacle of claim 6, wherein said indents are further offset laterally from respective opposed indents to ensure stability and security of an elongated contact tip within said receptacle.

8. An electrical connector receptacle for receiving a blade-type male terminal connector, said receptacle comprising:

a longitudinal body portion having a longitudinal body axis;

a rearward portion extending rearwardly from said body portion for engaging a wire; and a forward portion including opposed first and second elongated cantilevered spring arms projecting from said longitudinal body portion, generally parallel to said longitudinal body axis and located on opposite sides of said axis, each said spring arm being substantially planar said planes being spaced apart and parallel to each other, such that said spring arms form respective first and second vertical sides of said forward portion;

said first spring arm including a first pair of longitudinally spaced cantilevered tabs extending generally perpendicularly from opposite edges of said first arm on opposite sides of said axis, said second spring arm including a second pair of longitudinally spaced cantilevered tabs extending generally perpendicularly from opposite edges of said second spring arm on opposite sides of said axis, each said tab of said second pair of tabs being on an opposite side of said axis from the adjacent tab of said first pair of tabs whereby said first and second pair of tabs combine to form first and second horizontal sides of said forward portion, and further whereby said first and second pair of tabs present opposed contact points which deflect vertically during insertion of a blade-type male terminal between said top and bottom walls.

9. The receptacle of claim 8, wherein each of said tabs includes a convex dome contact area extending inwardly toward said axis, each said dome contact area serving as a contact point between said receptacle and a blade-type male terminal.

10. The receptacle of claim 9, wherein said dome contact areas are further offset laterally from respective opposed dome contact areas to ensure stability and security of a blade-type terminal within said receptacle.

11. The receptacle of claim 8, wherein each said tab is generally parallel to a horizontal plane passing through said axis, with an inward tilt toward said horizontal plane so that the free end of each tab is closer to said horizontal plane than is the point at which said tab connects to the edge of one of said spring arms.

12. The receptacle of claim 8, wherein said spring arms and said tabs are composed of resilient unitary beam components to provide horizontal and vertical deflection and torsion about said receptacle longitudinal body axis.

13. The receptacle of claim 8, wherein said body portion includes indents for receiving a hood, and further including a hood secured to said body portion by crimping said hood at locations coinciding with said indents in said body portion, wherein said hood extends forwardly along said receptacle longitudinal axis, enclosing said two opposed elongated spring arms.

14. A electrical connector receptacle for receiving a plug-type terminal having an elongated contact tip, said receptacle comprising:

a longitudinal body portion having a longitudinal body axis;

a rearward portion extending rearwardly from said body portion for engaging a wire; and a forward portion including first and second spaced, opposed spring arms connected at respective first ends to said body portion and extending from said body portion forwardly to respective free ends, said arms being generally planar and disposed in parallel vertical planes on opposite sides of said axis, thereby forming sidewalls of said receptacle, with each said spring arm having an upper edge and a lower edge;

a pair of opposed cantilevered forward tabs extending inwardly from said spring arms, one of said forward tabs extending from the lower edge of said first spring arm toward said second spring arm, and the other of said forward tabs extending from the upper edge of said second spring arm toward said first spring arm; and a pair of opposed cantilevered rearward tabs, longitudinally spaced from said pair of forward tabs, extending inwardly from said spring arms, one of said rearward tabs extending from the upper edge of said first spring arm and one of said rearward tabs extending from the lower edge of said second spring arm, whereby said forward and rearward tabs extend generally across the width of the space between said first and second spring arms thereby forming a generally enclosed receptacle for receiving a plug-type terminal having an elongated contact tip.

15. The receptacle of claim 14, wherein each tab includes an indent extending inwardly toward said receptacle longitudinal body axis constituting a contact area.

16. The receptacle of claim 14 wherein each said tab is generally planar and disposed generally parallel to a horizontal plane passing through said axis, with an inward tilt toward said horizontal plane so that the free end of each tab is closer to said horizontal plane than is the point at which said tab connects to the edge of one of said spring arms.

17. The receptacle of claim 14, wherein said body portion includes indents for receiving a hood, and further including a hood secured to said body portion by crimping said hood at locations coinciding with said indents in said body portion, wherein said hood extends forwardly along said receptacle longitudinal axis, enclosing said two opposed elongated spring arms.

18. The receptacle of claim 14, wherein said spring arms and said tabs are composed of resilient unitary beam components to provide horizontal and vertical deflection and torsion about said receptacle longitudinal body axis.

19. The receptacle of claim 14, wherein each said tab is comprised of plural beam components to allow said tabs to deflect and twist, absorbing overstress forces and torque forces produced by insertion and removal of said elongated contact tip into and out of said receptacle.

* * * * *